US011417980B2

(12) United States Patent
Yen

(10) Patent No.: US 11,417,980 B2
(45) Date of Patent: Aug. 16, 2022

(54) ELECTRICAL PLUG WITH AN OVERCURRENT PROTECTIVE DEVICE

(71) Applicant: Chun-Chang Yen, Hsinchu (TW)

(72) Inventor: Chun-Chang Yen, Hsinchu (TW)

( * ) Notice: Subject to any disclaimer, the term of this patent is extended or adjusted under 35 U.S.C. 154(b) by 0 days.

(21) Appl. No.: 17/126,913

(22) Filed: Dec. 18, 2020

(65) Prior Publication Data

US 2022/0200188 A1 Jun. 23, 2022

(51) Int. Cl.

| | |
|---|---|
| ***H01R 13/66*** | (2006.01) |
| ***H01R 13/453*** | (2006.01) |
| ***H01R 13/631*** | (2006.01) |
| *H01R 103/00* | (2006.01) |

(52) U.S. Cl.

CPC ..... *H01R 13/4538* (2013.01); *H01R 13/631* (2013.01); *H01R 2103/00* (2013.01)

(58) Field of Classification Search

CPC ..... H01R 13/684; H01R 13/644; H01R 13/4538; H01R 13/631

See application file for complete search history.

(56) References Cited

U.S. PATENT DOCUMENTS

| | | | | |
|---|---|---|---|---|
| 4,592,613 | A * | 6/1986 | Tong | H01R 13/68 337/213 |
| 4,738,639 | A * | 4/1988 | Henderson | H01R 13/68 439/620.32 |
| 4,846,723 | A | 7/1989 | Pong | |
| 5,154,642 | A | 10/1992 | Chung-Yin | |
| 5,457,445 | A * | 10/1995 | Su | H01R 13/68 337/198 |
| 5,482,478 | A | 1/1996 | Liao | |
| 5,704,811 | A | 1/1998 | Hsu | |
| 5,798,683 | A * | 8/1998 | Lin | H01R 13/68 337/260 |
| 5,906,515 | A | 5/1999 | Lin | |
| 6,039,607 | A | 3/2000 | Cheung | |
| 6,468,111 | B1 | 10/2002 | Weng | |
| 6,547,600 | B2 * | 4/2003 | Yen | H01R 13/585 439/620.3 |
| 7,029,332 | B2 * | 4/2006 | Chien | H01R 24/28 439/106 |
| 7,344,414 | B2 | 3/2008 | Kuo | |
| 7,705,706 | B2 | 4/2010 | Ding | |
| 8,328,581 | B2 * | 12/2012 | de Chazal | B60L 3/00 439/620.28 |
| D701,835 | S | 4/2014 | Byrne et al. | |
| D716,735 | S | 11/2014 | Byrne et al. | |

(Continued)

FOREIGN PATENT DOCUMENTS

CN 200420073003.X U 7/2004

*Primary Examiner* — Neil Abrams

(74) *Attorney, Agent, or Firm* — Seed IP Law Group LLP

(57) ABSTRACT

An electrical plug includes an inner housing slidably received within an outer housing. The inner housing includes corrugations at an end of the inner housing to prevent an electrical cable from pulling out of the plug. The inner housing also includes a protrusion that is structured to be received in an aperture of the outer housing to couple the inner housing and the outer housing and provide a visual indicator of proper assembly. The electrical plug further includes fuse clips that increase the contact area between terminals and fuses of the plug, which improves reliability.

20 Claims, 5 Drawing Sheets

(56) References Cited

U.S. PATENT DOCUMENTS

| | | | | |
|---|---|---|---|---|
| 8,998,659 | B2 * | 4/2015 | Sato | H01R 4/70 439/877 |
| 10,109,961 | B1 * | 10/2018 | Lin | H01R 13/688 |
| 10,164,382 | B1 * | 12/2018 | Yen | H01R 13/688 |
| 2011/0117782 | A1 | 5/2011 | Su | |

* cited by examiner

ELECTRICAL PLUG WITH AN OVERCURRENT PROTECTIVE DEVICE

BACKGROUND

Technical Field

The present disclosure generally relates to an electrical plug and, more particularly, to an electrical plug for use in light sets with improved electrical contacts and a quality control indicator to ensure proper assembly during manufacturing.

Description of the Related Art

It is well known that electrical plugs are used to connect strings of lights to exterior circuits or power supplies. However, existing electrical plugs, particularly those used with light sets, have a number of disadvantages. For example, the electrical cables connected to the plugs can pull out of the plug, which leads to failure of the light set and the plug. Further, known electrical plugs do not create sufficient contact with fuses in the plug, such that a higher temperature might be created between the contacts during operation, which increases risk. Finally, although some aspects of the construction of electrical plugs have been automated, known electrical plugs do not include sufficient quality control indicators to ensure proper construction, which increases the risk that plugs are misassembled and will not function properly during operation.

BRIEF SUMMARY

The present disclosure generally describes an electrical plug with an outer housing and an inner housing. The outer housing has an interior cavity extending through the outer housing such that the inner housing can be slidably received within the outer housing. The outer housing further includes an aperture through the outer housing and the inner housing includes a protrusion. When the inner housing is received in the outer housing in an operating position, the protrusion of the inner housing is received in the aperture of the outer housing to couple the inner and outer housings together. The protrusion of the inner housing is also visible through the aperture to provide a visual indicator that the plug is correctly assembled during quality control inspections.

The inner housing further includes a plurality of corrugations or other gripping features at one end of the inner housing that are structured to engage a jacket of an electrical cable. The corrugations resist the electrical cable from pulling out of the plug during operation.

The inner housing also includes at least a first and second cavity that are structured to receive fuses. A first fuse clip including a first blade coupled to a flange is coupleable to the inner housing with the flange received in the first cavity of the inner housing in the operating position for contacting a first fuse. A second fuse clip including a first flange, a second flange, and a third flange is also coupleable to the inner housing. The first flange of the second fuse clip is received in the first cavity of the inner housing in the operating position for contacting the first fuse. The second flange is structured to be crimped around at least one strand of wire of a first electrical wire of the electrical cable and the third flange is structured to be crimped around wire insulation of the first electrical wire of the electrical cable in the operating position. The fuse clips improve contacts with the fuses of the electrical plug to improve reliability of the plug.

BRIEF DESCRIPTION OF THE SEVERAL VIEWS OF THE DRAWINGS

For a better understanding of the embodiments, reference will now be made by way of example only to the accompanying drawings. In the drawings, identical reference numbers identify similar elements or acts. In some drawings, the sizes and relative positions of elements are not necessarily drawn to scale. For example, the shapes of various elements and angles may be enlarged and positioned to improve drawing legibility in some drawings. In some drawings, the size and relative position of elements are exactly to scale.

DETAILED DESCRIPTION

Figure 1:
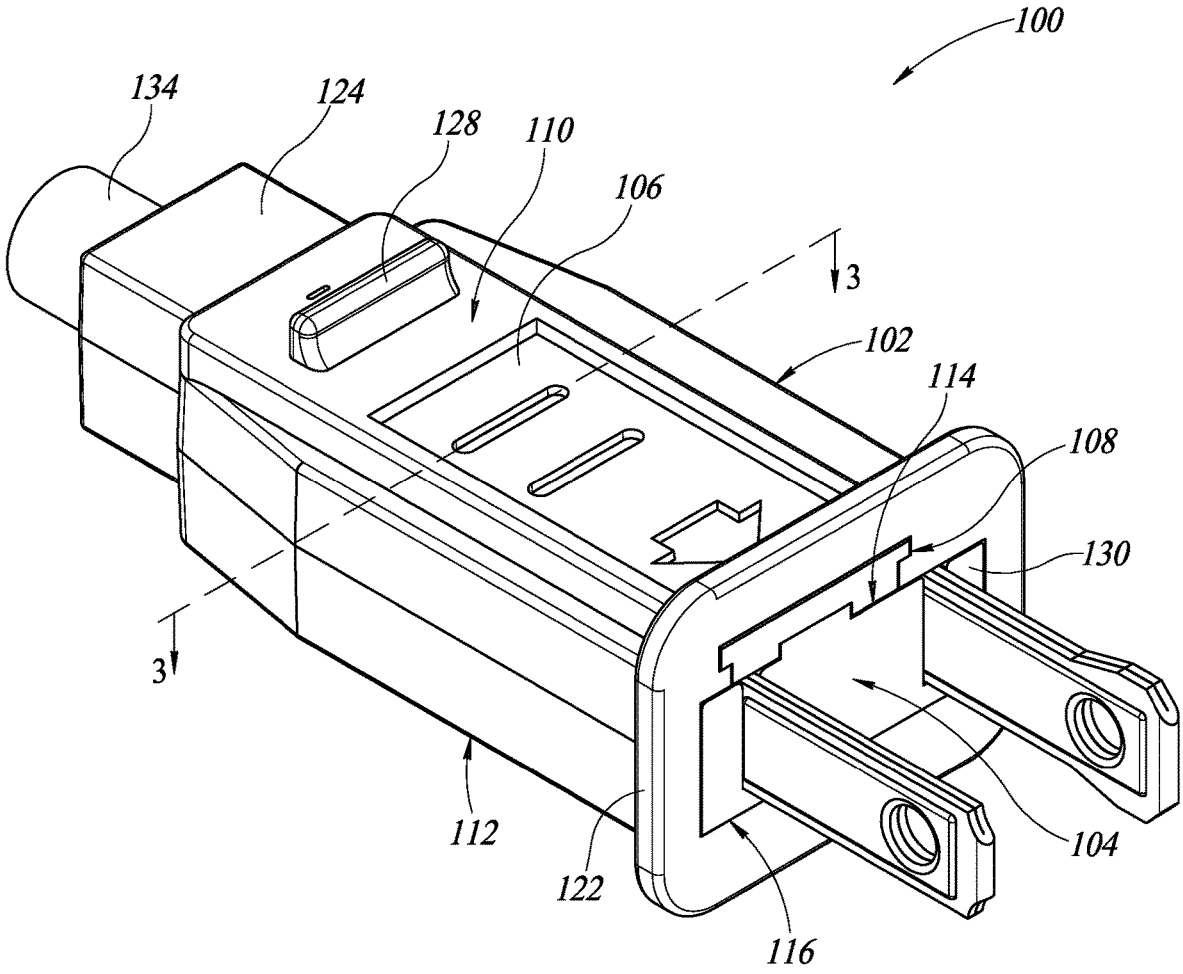
FIG. 1 is an isometric view of an embodiment of an electrical plug according to the present disclosure in an operating configuration.

The present disclosure is generally directed to an electrical plug with a construction to improve quality control during assembly and reliability during operation. FIG. 1 illustrates an electrical plug 100 (which may also be referred to herein as a plug 100) in an operating and fully assembled configuration. The plug 100 includes an outer housing 102 and an inner housing 104 received within the outer housing 102. In some embodiments, the plug 100 further includes a door 106 that is configured to slide along a track 108 in the outer housing 102 to selectively provide access to an interior of the plug 100, such as to change a fuse. The outer housing 102, the inner housing 104, and the door 106 can be formed of plastic or any other selected material and in some non-limiting examples, can be formed by injection molding, blowing molding, compression molding, thermoforming, or any other like process.

The outer housing 102 of the plug 100 includes a first surface 110 and a second surface 112 opposite to the first surface 110. In some embodiments, the first surface 110 is a top or uppermost surface and the second surface 112 is a bottom or lowermost surface. The inner housing 104 similarly includes a first surface 114 and a second surface 116 opposite to the first surface 114. In some embodiments, the first surface 114 of the inner housing 104 is a top or uppermost surface and the second surface 116 of the inner housing 104 is a bottom or lowermost surface.

Figure 2:
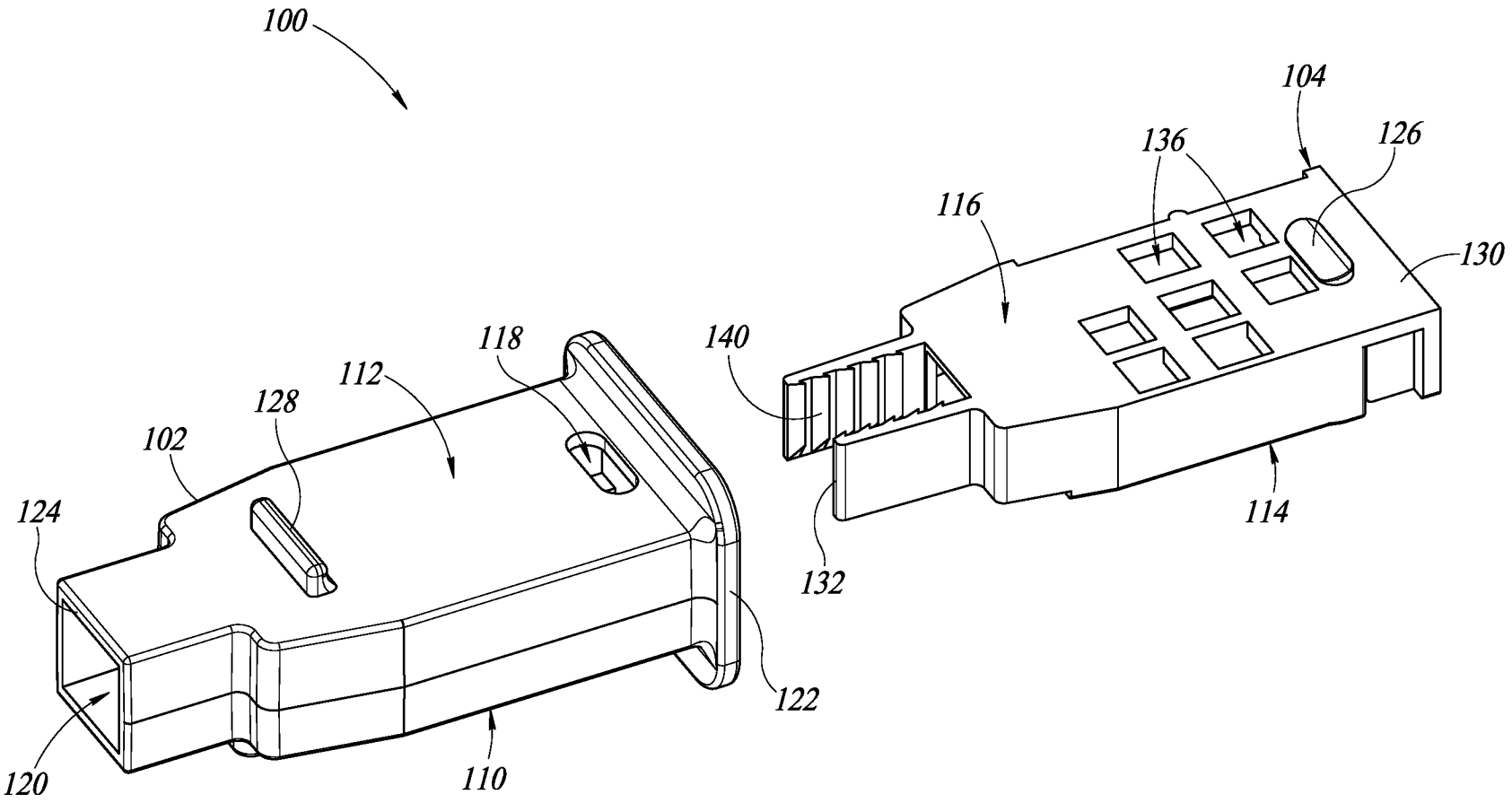
FIG. 2 is an exploded view of the electrical plug of FIG. 1 illustrating an outer housing and an inner housing of the electrical plug in an unassembled configuration.

FIG. 2 is an exploded bottom view of the outer housing 102 and the inner housing 104 showing the outer housing 102 and the inner housing 104 in an unassembled or non-operating configuration. The remaining components of the plug 100 have not been included for clarity. Specifically, FIG. 2 illustrates the second surface 112 of the outer housing 102 and the second surface 116 of the inner housing 104 in more detail. The outer housing 102 includes an aperture 118 in the second surface 112 that extends through the outer housing 102. Further, the outer housing 102 includes an interior cavity 120 extending through an entirety of the outer housing 102 from a first end 122 of the outer housing 102 to an opposing second end 124 of the outer housing 102. The aperture 118 is in communication with the interior cavity 120 of the outer housing 102. As shown in FIG. 1, the inner housing 104 is structured and has a size and a shape to be slidably received within the interior cavity 120 of the outer housing 102.

In the illustrated embodiment, the inner housing 104 includes a protrusion 126 extending from the second surface 116 of the inner housing 104. The protrusion 126 of the inner housing 104 has a size and shape to be received in the aperture 118 in the outer housing 102 to couple and secure the outer housing 102 to the inner housing 104 in the operating configuration illustrated in FIG. 1. Further, the protrusion 126 of the inner housing 104 is visible through the aperture 118, such that the protrusion 126 provides a visual indicator during quality control inspections that the plug 100 is correctly assembled. Other embodiments may have two or more protrusions 126 collectively sized, shaped and oriented to engage the aperture 118. In some embodiments, the outer housing 102 further includes protrusions 128 extending from at least one, or both, of the first and second surfaces 110, 112 of the outer housing 102 that assist the user in manipulating the plug 100.

The inner housing 104 further includes a first end 130 and a second end 132 opposite the first end 130. In the operating configuration shown in FIG. 1, the first end 122 of the outer housing 102 is proximate to the first end 130 of the inner housing 104 and the second end 124 of the outer housing 104 is proximate to the second end 132 of the inner housing 104. In some embodiments, the first ends 122, 130 of the housings 102, 104 are the end of the plug 100 with terminals for connection of the plug 100 to an external power source, such as a socket, and the second ends 124, 132 are the end of the plug 100 where an electrical cable 134 (FIG. 1) is connected to the plug 100.

As shown in FIG. 2, the aperture 118 in the outer housing 102 and the protrusion 126 of the inner housing 104 are positioned proximate to the first ends 122, 130 of the housings 102, 104 and are closer to the first ends 122, 130 than the second ends 124, 132 of the housings 102, 104. The location of the aperture 118 and the protrusion 126 ensures that the protrusion 126 is seated in the aperture 118 when the inner housing 104 is fully received within the outer housing 102, or in other words, this location of the aperture 118 and the protrusion 126 ensures proper assembly before the protrusion 126 can be received in the aperture 118. In some embodiments, the inner housing 104 includes a plurality of openings 136 in the second surface 116 of the inner housing 104. While FIG. 2 illustrates seven openings 136 in three rows and three columns, with three openings 136 in the middle row and two pairs of openings 136 offset from each other on either side of the middle row, the number and arrangement of openings 136 can be selected according to design preference. The openings 136 allow any liquid that enters the plug 100 to drain to the bottom of the plug 100 and avoid pooling in the inner housing 104, which reduces the risk of damage to the electrical components received in the inner housing 104. The inner housing 104 also includes a plurality of corrugations 140, teeth or similar features extending from the second end 132 of the inner housing 104, as further explained with reference to FIG. 3.

Figure 3:
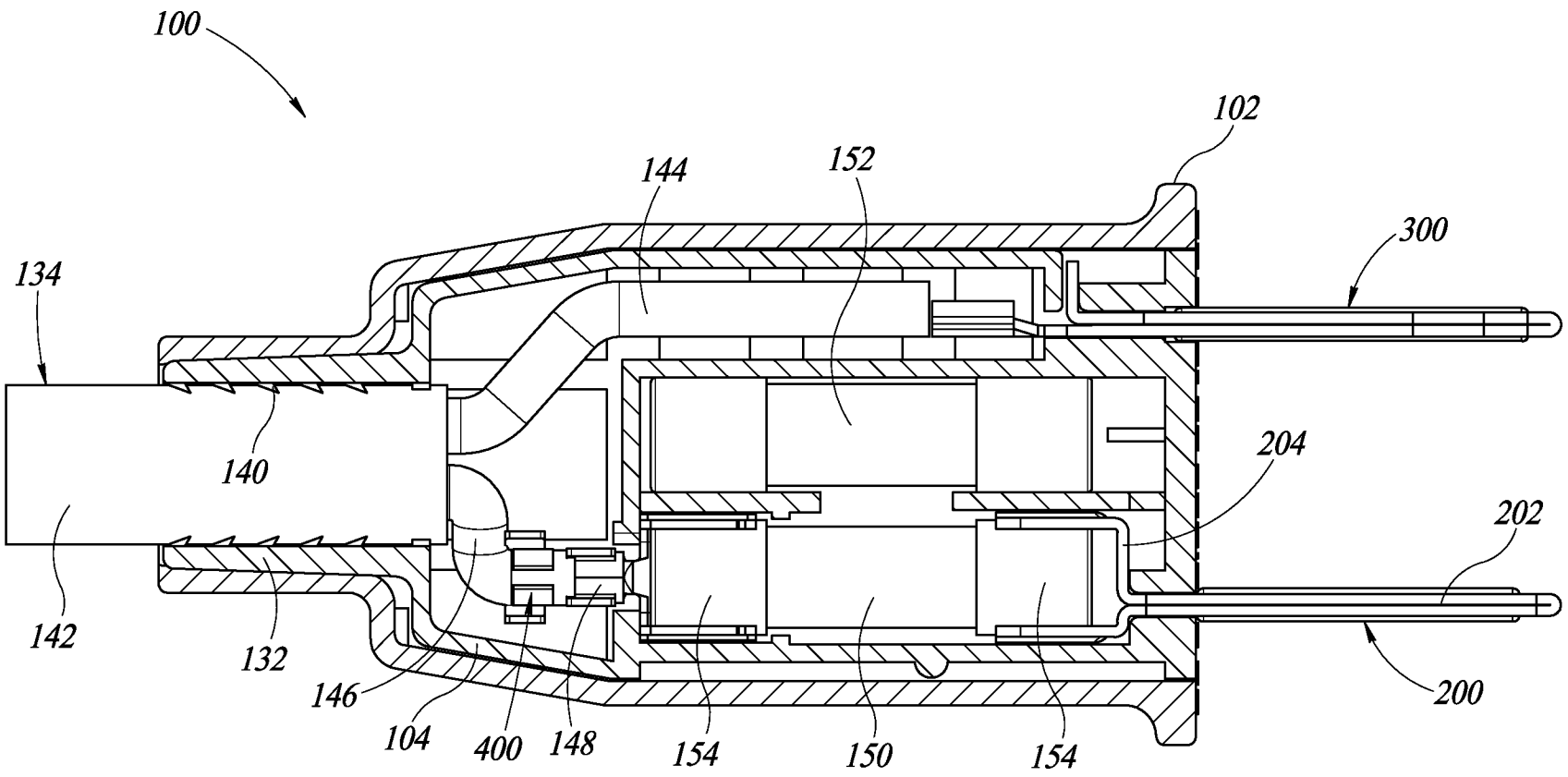
FIG. 3 is a cross-sectional view of the electrical plug of FIG. 1 along line 3-3 in FIG. 1.

FIG. 3 is a cross-sectional view of the plug 100 along line 3-3 in FIG. 1. The plug 100 is illustrated in FIG. 3 in the fully assembled, operating configuration and includes the inner housing 104 received within the outer housing 102. The inner housing 104 will be described in more detail with reference to FIG. 4. As shown in FIG. 3, the inner housing 104 includes the corrugations 140 at the second end 132 of the inner housing 104, wherein the corrugations 140 engage a jacket 142 of the electrical cable 134. The electrical cable 134 includes the jacket 142 surrounding a first electrical wire 144 and a second electrical wire 146. Each of the electrical wires 144, 146 include at least one strand of wire 148 inside of wire insulation. The corrugations 140 are structured to resist the electrical cable 134 and wires 144, 146 from pulling out of the plug 100. In other words, as shown in FIG. 3, the corrugations 140 are structured to dig into the jacket 142 of the electrical cable 134 to prevent the cable 134 from being pulled away from the plug 100. In some embodiments, the corrugations are included only at the second end 132 of the inner housing 104.

The plug 100 further includes a first fuse 150 and a second fuse 152 received in the inner housing 104. In some embodiments, the first fuse 150 is in electrical communication with the plug 100 and the second fuse 152 is a replacement fuse. As such, when the first fuse 150 fails, the first fuse 150 can be replaced with the second fuse 152 to extend the operational life of the plug 100 without additional parts. Each fuse 150, 152 includes end caps 154, which in some embodiments, are formed of metal. The plug 100 also includes a first fuse clip 200 coupled to the inner housing 104 in the operating configuration shown in FIG. 3. The first fuse clip 200 will be described in greater detail with reference to FIG. 5, but briefly, the first fuse clip 200 includes a first blade 202 coupled to a flange 204 as a single, integral, unitary component. The flange 204 may also be referred to herein as a tab 204. The flange 204 receives one of the end caps 154 of the first fuse 150 to create an electrical connection between the first fuse clip 200 and the first fuse 150. The plug 100 also includes a second blade 300 coupled to the plug 100 in the operating configuration. The second blade 300 is electrically connected to the second electrical wire 144 through a crimped connection with one or more strands of wire of the second electrical wire 144. The second blade 300 is described in greater detail herein with reference to FIG. 6. Finally, the plug 100 includes a second fuse clip 400 coupled to the inner housing 104 in the operating configuration. The second fuse clip 400 is described in greater detail with reference to FIG. 7.

Figure 4:
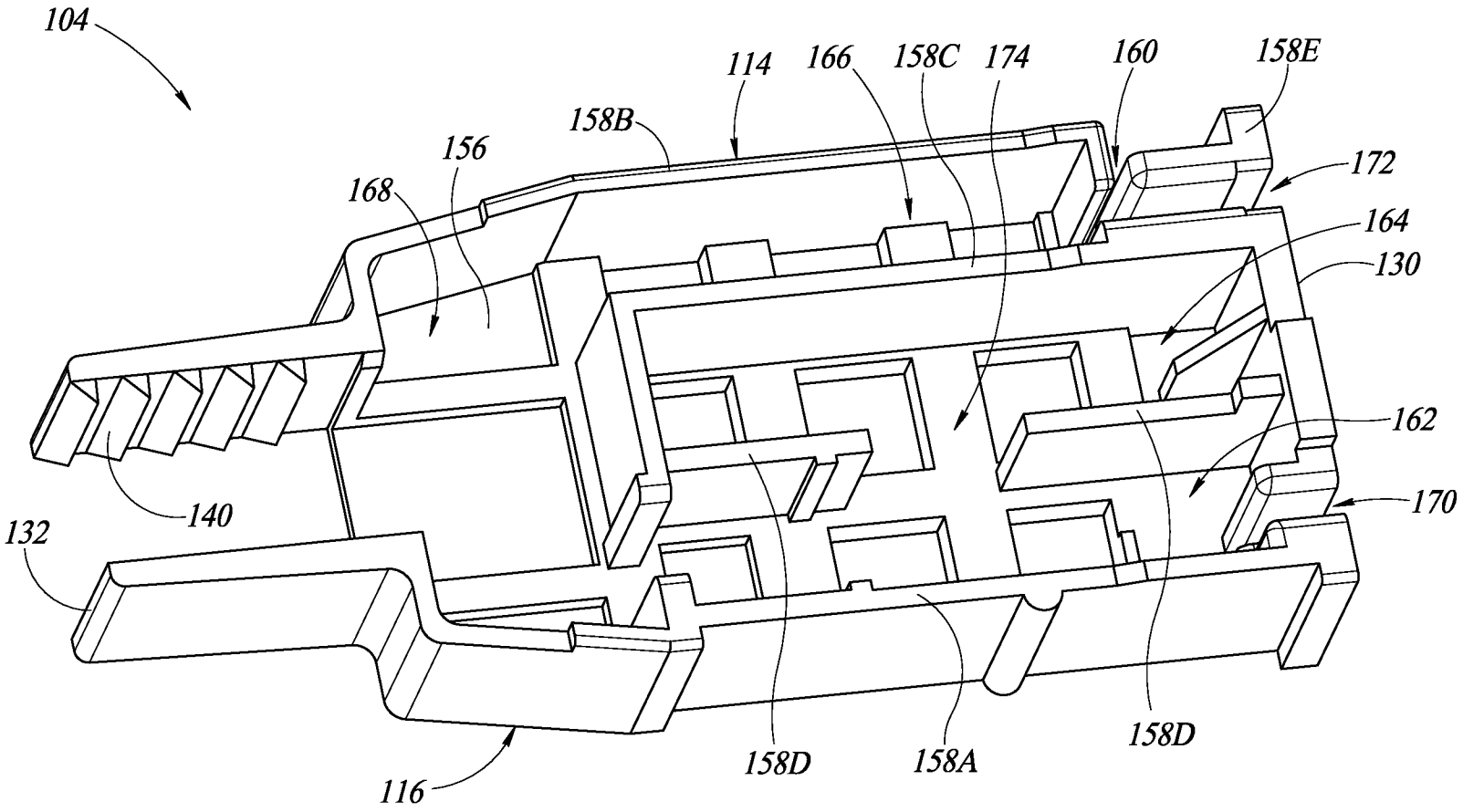
FIG. 4 is an isometric view of the inner housing of the electrical plug of FIG. 1.

FIG. 4 is an isometric view of the inner housing 104 isolated from the remaining components of the plug 100. The inner housing 104 includes the first surface 114 and the second surface 116 as well as the first end 130 and the second end 132. The inner housing 104 further includes a base 156 and a plurality of walls, collectively referred to as 158, coupled to and extending from the base 156. In some embodiments, the walls 158 are perpendicular to the base 156 and include a first wall 158A, a second wall 158B, a third wall 158C, a fourth wall 158D, and a fifth wall 158E. The first and second walls 158A, 1586 are opposite to each other and define outer boundaries of the inner housing 104. Further, the corrugations 140 extend from the first and second walls 158A, 158B at the second end 132 of the inner housing 104. The third wall 158C and the fourth wall 158D are located between the first and second walls 158A, 1586 and the fifth wall 158E is aligned with the second wall 1586, but is separated from the second wall 1586 by an aperture 160. The aperture 160 is in communication with the third cavity 166, in some embodiments.

The first wall 158A and the fourth wall 158D define a first cavity 162 in the inner housing 104 and the fourth wall 158D and the third wall 158C define a second cavity 164 in the inner housing 104. As shown in FIG. 3, the cavities 162, 164 are structured to receive fuses 150, 152, respectively. The second wall 158B and the third wall 158C define a third cavity 166 that is structured to receive the first electrical wire 144, as shown in FIG. 3. In some embodiments, the third cavity 166 also includes the area of the inner housing 104 defined by the first and second walls 158A, 1586 that receives the first and second wires 144, 146, as shown in FIG. 3. In some embodiments, the area toward the second end 132 of the inner housing 104 that receives the wires 144, 146 is a fourth cavity 168 defined by the first and second walls 158A, 1586 and the third wall 158C. In some embodiments, each of the cavities 162, 164, 166, 168 is in communication with each other in order to allow for electrical connections between the various components in the cavities 162, 164, 166, 168.

Further, the inner housing 104 includes a first blade aperture 170 at the first end 130 of the inner housing 104 between the first wall 158A and the third wall 158C as well as a second blade aperture 172 at the first end 130 of the inner housing 104 between the third wall 158C and the fifth wall 158E. The first blade aperture 170 is in communication with the first cavity 162 and the second blade aperture 172 is in communication with the third cavity 166 in order to enable electrical connections, as described in greater detail below. The inner housing 104 may also include an aperture 174 between portions of the fourth wall 158D, in some embodiments, such that the fourth wall 158D electrically isolates the cavities 162, 164 and fuses 150, 152 from each other while also enabling communication between the cavities 162, 164. The aperture 174 also enables a user to more easily manipulate the fuses 150, 152 in and out of the cavities 162, 164.

Figure 5:
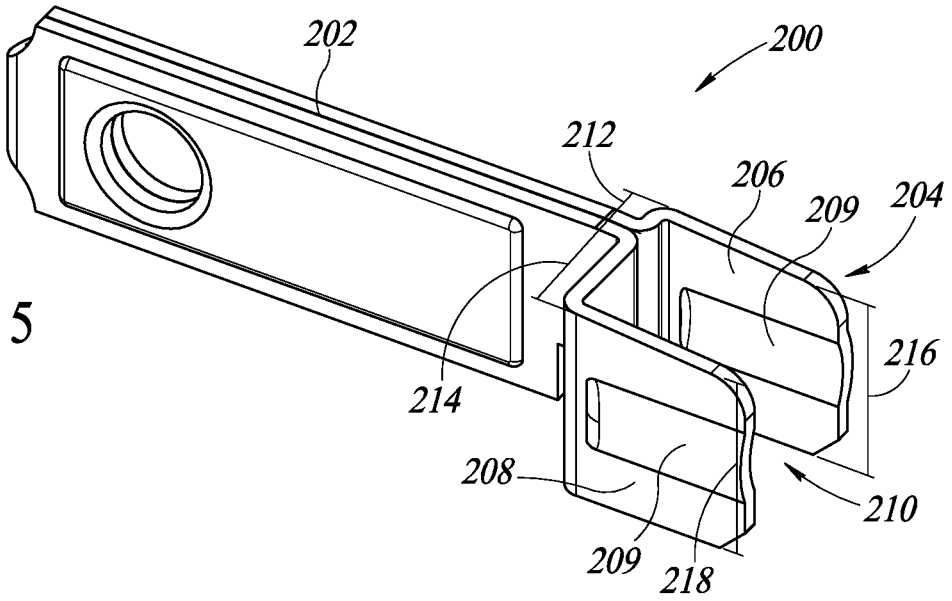
FIG. 5 is an isometric view of an embodiment of a first fuse clip having a first blade and a flange according to the present disclosure.

Turning to FIG. 5, with continuing reference to FIG. 3 and FIG. 4, the plug 100 further includes the first fuse clip 200 having the first blade 202 coupled to the flange 204. The first blade 202 is received at least partially in the first blade aperture 170 in the inner housing 104 and extends away from the first end 130 of the inner housing 104, and the flange 204 is received in the first cavity 162 of the inner housing 104 in the operating configuration shown in FIG. 3. Further, the first fuse 150 is received in the first cavity 162 of the inner housing 104 in the operating configuration with one end cap 154 of the first fuse 150 in contact with the flange 204 of the first fuse clip 200.

The flange 204 of the first fuse clip 200 includes a first wall 206 and a second wall 208 that are opposed from each other across a space 210. The end cap 154 of the first fuse 150 is received in the space 210 and in contact with the walls 206, 208. As shown in FIG. 5, the first wall 206 and the second wall 208 are generally parallel to the first blade 202, in some embodiments. This arrangement and orientation of the walls 206, 208 enables manipulation of the fuse 150 into and out of contact with the flange 204, as shown in FIG. 3. In other words, the arrangement of the flange 204 makes it easier for a user to change the first fuse 150, because the walls 206, 208 of the flange 204 do not block the user from inserting or removing the fuse 150. In one or more embodiments, the first fuse clip 200 includes a single piece of metal folded or crimped in half to form the blade 202, with ends flared out to form the flange 204. The two pieces of metal of the blade 202 may be bonded together with an adhesive or may be soldered together to ensure the fuse clip 200 maintains its shape, in some embodiments.

Further, the first wall 206 and the second wall 208 are offset relative to the first blade 202. In other words, the first wall 206 is spaced from a center line through the blade 202 by a first distance 212 and the second wall 208 is spaced from the center line through the blade 204 by a second distance 214 that is greater than the first distance 212. In some embodiments, the distance 212 is equal to the distance 214 or the distance 212 is greater than the distance 214. The first wall 206 also has a first height 216 and the second wall has a second height 218 equal to the first height 216 in some embodiments. In some embodiments, the heights 216, 218 are different. The walls 206, 208 of the flange 204 can also have the same size and shape or may have a different size and shape, in one or more embodiments.

In some embodiments, each of the walls 206, 208 has a concave arc 209. The concave arc 209 improves contact between the walls 206, 208 and the rounded surface of the end caps 154. As such, the concave arc 209 has a size and a shape to receive and contact the ends caps 154, in one or more embodiments. As shown in FIG. 5, the concave arc 209 is present in both walls 206, 208, although in some embodiments, the arc 209 is only in one or neither of the walls 206, 208. Further, the concave arc 209 may extend less than the total height 216 and width of each wall 206, 208 as in FIG. 5, or the entire wall 206, 208 may be shaped in a concave form in one or more embodiments.

Figure 6:
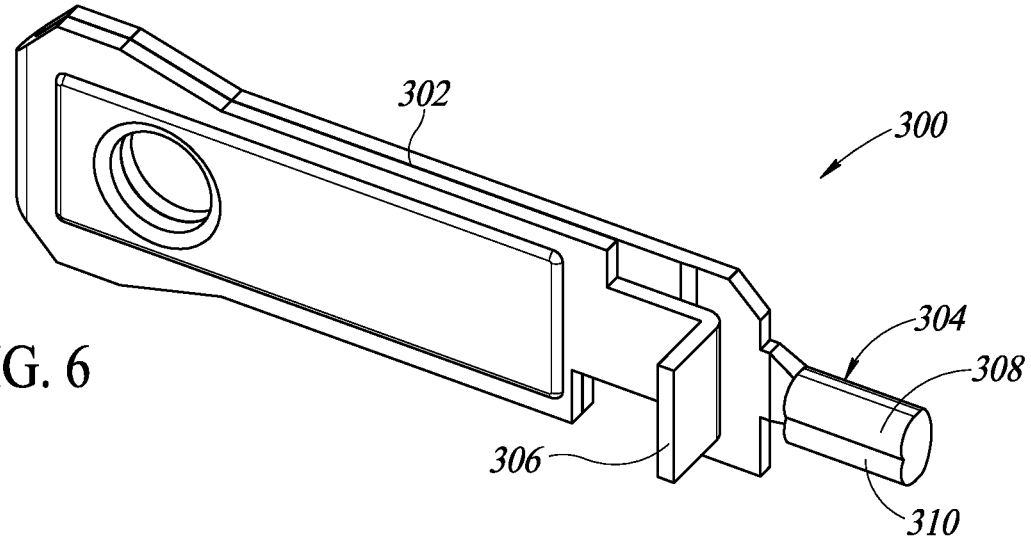
FIG. 6 is an isometric view of an embodiment of a second blade according to the present disclosure.

FIG. 6 is an isometric view of the second blade 300. The second blade 300 includes a blade portion 302 and a connection portion 304. The blade portion 302 may be similar to the first blade 202 in some embodiments, except a size and a shape of the blade portion 302 may be the same or different than the first blade 202 to accommodate different types of sockets. The second blade 300 further includes a protrusion 306 extending perpendicularly from the blade portion 302 and the connection portion 304. In other words, the second blade 300, including the blade portion 302 and the connection portion 304, generally extend in a first direction along an axis defined by the blade portion 302 and the connection portion 304. The protrusion 306 extends in a second, different direction, which in some embodiments, is perpendicular to the first direction.

As shown in FIG. 6, the second blade 300 may include a single piece of metal folded in half with the halves coupled to each other to form the blade portion 302. One end of one of the halves is flared out to form the protrusion 306 and the end of the other half includes the connection portion 304. While the protrusion 306 is illustrated as being generally perpendicular to the second blade 300 and the blade portion 302 and the connection portion 304, the protrusion 306 can be at any transverse angle to the blade portion 302 in some embodiments. In some embodiments, the protrusion 306 is at an angle to the blade portion 302 that is not equal to 0 degrees.

With reference to FIG. 3 and FIG. 4, the protrusion 306 is received in the aperture 160 between the second wall 158B and the fourth wall 158E to couple the second blade 300 to the inner housing 104 and prevent the second blade 300 from pulling out of the plug 100 during operation. Further, the blade portion 302 is received in the second blade aperture 172 at the first end 130 of the inner housing 104 and extends away from the first end 130 of the inner housing 104 to enable a connection to a socket. The connection portion 304 is received in the third cavity 166 and is crimped around at least one strand of wire of the first electrical wire 144 of the cable 134. As such, the first electrical wire 144 is received at least partially in the third cavity 166 of the inner housing 104 along with the connection portion 304 of the second blade 300. In some embodiments, the first electrical wire 144 also extends through the fourth cavity 168 in the inner housing 104.

In some embodiments, the plug 100 may include a second fuse in electrical communication with the first electrical wire 144, in which case, the second blade 300 may include a fuse clip of the types described herein, instead of the connection portion 304. In an unassembled position, the connection portion 304 includes a first tab 308 and a second tab 310 that are crimped around at least one strand of wire in the operating position shown in FIG. 3 to enable electrical communication between the second blade 300 and the electrical wire 144.

Figure 7:
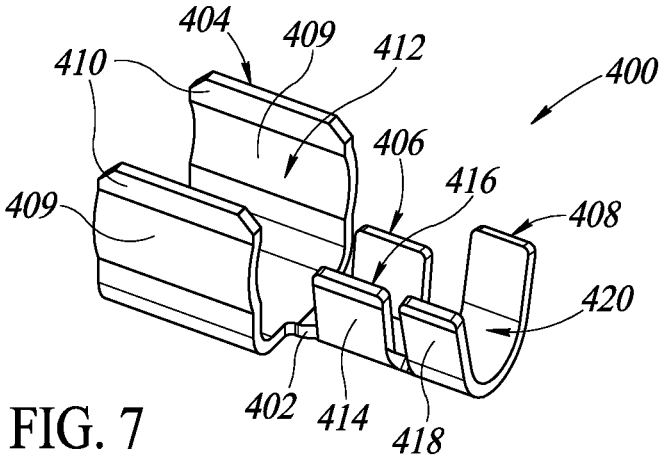
FIG. 7 is an isometric view of an embodiment of a second fuse clip according to the present disclosure.

FIG. 7 is an isometric view of the second fuse clip 400. The second fuse clip 400 includes a base 402 with a first flange 404, a second flange 406, and a third flange 408 coupled to and extending away from the base 402. The flanges 404, 406, 408 may also be referred to herein as tabs 404, 406, 408, respectively. The first flange 404 of the second fuse clip 400 includes opposing walls 410 separated by a space 412. The opposing walls 410 may also be referred to herein as a first wall 410 and a second wall 410 separated by the space 412. Similarly, the second flange 406 includes opposing walls 414 separated from each other by a space 416 and the third flange 408 includes opposing walls 418 separated by a space 420. In one or more embodiments, each of the opposing walls 410 of the first flange 404 includes a concave arc 409. The concave arc 409 may include some, or all, of the features of the concave arc 209 described above with reference to FIG. 5. The concave arcs 409 in the walls 410 of the first flange 404 improve contact with the end caps 154 of the first fuse 150 (see FIG. 3). As such, the walls of the flanges described herein are not flat and planar in some embodiments, but rather, have a curved design and shape to accommodate fuse end caps and improve contact between the flanges and the fuse end caps, which improves reliability of the plug and reduces the risk of the plug overheating during operation.

In some embodiments, the first flange 404 is the largest flange of the second fuse clip 400. In other words, the first flange 404 has a height from the base 402 to an uppermost edge of the first flange 404 that is greater than a height of the second flange 406 and a height of the third flange 408 measured in a similar manner. Further, the first flange 404 has a width between the walls 410 that is greater than a width between the walls 414 of the second flange 406 and a width between the walls 418 of the third flange 408. In some embodiments, the height and width of the third flange 408 is also greater than the second flange 406, such that the second flange 406 is the smallest flange of the second fuse clip 400 and is located between the first and third flanges 404, 408.

With reference to FIG. 3 and FIG. 4 and with continuing reference to FIG. 7, the second fuse clip 400 is coupleable to the inner housing 104 with the first flange 404 received at least partially, if not wholly, in the first cavity 162 of the inner housing 104. The first flange 404 is structured to receive the other end cap 154 of the first fuse 150, such that the first flange 404 is in contact with the end cap 154 of the first fuse 150 to enable electrical communication with the fuse 150. The second flange 406 and the third flange 408 are received in the fourth cavity 168 (or the third cavity 166, in some embodiments) with the second flange 406 structured to be crimped around at least one strand of wire of the second electrical wire 146. The third flange 408 is structured to be crimped around electrical insulation of the second wire 146. As such, the sizes of the flanges 404, 406, 408 can be selected according to connection type. While the flanges 404, 406, 408 are all a different size in some embodiments, such as the embodiment shown in FIG. 7, the flanges 404, 406, 408 can be different sizes or be selected to have different dimensions in one or more embodiments.

Further, the plug 100 includes two fuse clips 200, 400 to increase the contact area between the end caps 154 of the first fuse 150, which improves performance of the plug 100. The walls 410 of the first flange 404 of the second fuse clip 400 are arranged differently than the walls 206, 208 of the flange 204 of the first fuse clip 200, however. In one non-limiting example, the walls 206, 208 of the first fuse clip 200 extend horizontally or in a first direction from the blade 202 and the walls 410 of the first flange 404 of the second fuse clip 400 extend vertically, or in a different, second direction, relative to the base 402. As such, the flange 204 of the first fuse clip 200 contacts the end cap 154 of the first fuse on left and right portions of the end cap 154 while the first flange 404 of the second fuse clip 400 contacts the end cap 154 on the bottom, left, and right portions of the end cap 154. This arrangement of the second fuse clip 400 further increases the contact area, while also enabling a strong mechanical and electrical connection between the walls 410 of the first flange 404 and the base 402 of the second fuse clip 400. In other words, the walls 410 of the first flange 404 of the second fuse clip 400 are arranged differently than the walls 206, 208 of the flange 204 of the first fuse clip 200 because the arrangement results in stronger mechanical and electrical connections in the plug 100, which improves reliability. However, in some embodiments, the flanges 204, 404 of the fuse clips 200, 400 can be arranged similarly.

As will be readily appreciated from the foregoing, the present disclosure achieves an electrical plug that provides a strong connection between the terminals and fuses of the plug through fuse clips, while also providing for an easy-to-assemble process that is suitable for automation or handwork. More particularly, because construction of the plugs according to the present disclosure includes sliding or pressing different pieces into place, the overall construction process may be automated because the construction process does not include any steps that are not suitable for automation. Further, the electrical plug includes an indicator that the plug is properly assembled to improve quality control and reduce the likelihood of failure as well as corrugations to prevent a cable from pulling out the plug, which improves reliability. As such, electrical plugs formed according to the present disclosure are more efficient to manufacture, which reduces consumer cost and labor inefficiencies, but because the plugs provide a stronger connection between the terminals and fuses, the same are also more reliable.

In the foregoing description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with electrical plugs have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to." Further, the terms "first,"

"second," and similar indicators of sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A plug, comprising:

an outer housing having an interior cavity extending through the outer housing and an aperture;

an inner housing having a first end and a second end, the inner housing coupleable to the outer housing within at least a portion of the interior cavity of the outer housing in an operating configuration and including:

a protrusion structured to be received in the aperture of the outer housing in the operating configuration to couple the inner housing to the outer housing;

a first cavity; and a second cavity;

a first fuse clip coupleable to the inner housing, the first fuse clip including a first blade terminating in a flange with the flange received in the first cavity of the inner housing in the operating configuration, the first blade configured to be received directly in a standard electrical outlet in the operating configuration, the flange of the first fuse clip including a first wall and a second wall, at least one of the first wall and the second wall including a concave arc;

a second fuse clip coupleable to the inner housing, the second fuse clip including a first flange, a second flange, and a third flange, the first flange received in the first cavity of the inner housing in the operating configuration, the second flange structured to be crimped around at least one strand of wire of a first electrical wire of an electrical cable and the third flange structured to be crimped around wire insulation of the first electrical wire of the electrical cable in the operating configuration; and a first fuse coupleable to the inner housing within at least a portion of the first cavity of the inner housing and in contact with the flange of the first fuse clip and the first flange of the second fuse clip in the operating configuration.

2. The plug of claim 1 wherein the first end of the inner housing is opposite to the second end of the inner housing, the protrusion of the inner housing being proximate to the first end of the inner housing.

3. The plug of claim 1 wherein the first wall and the second wall of the flange of the first fuse clip extend in a first direction and the first flange of the second fuse clip includes a third wall and a fourth wall extending in a second direction perpendicular to the first direction.

4. The plug of claim 1 wherein the second fuse clip includes a base with the first flange, the second flange, and the third flange extending from the base, the first flange having a first height relative to the base, the second flange having a second height relative to the base, and the third flange having a third height relative to the base, the first height being greater than the second height and greater than the third height.

5. The plug of claim 4 wherein the third height is greater than the second height.

6. The plug of claim 1 wherein the first flange of the second fuse clip has a first width, the second flange of the second fuse clip has a second width, and the third flange of the second fuse clip has a third width, the first width being greater than the second width and being greater than the third width.

7. The plug of claim 1 wherein in the inner housing further includes a third cavity, the plug further comprising:

a second fuse coupleable to the inner housing within at least a portion of the second cavity of the inner housing in the operating configuration; and a second blade coupleable to a second electrical wire of the electrical cable with the second electrical wire of the electrical cable received at least partially within the third cavity of the inner housing, the second blade including a protrusion extending transverse to the second blade and structured to be received in an aperture in the inner housing to couple the second blade to the inner housing in the operating configuration.

8. The plug of claim 1 wherein the concave arc of the at least one of the first wall and the second wall of the flange of the first fuse clip extends less than an entire height and less than an entire width of the at least one of the first wall and the second wall, and wherein the first wall and the second wall are parallel to the first blade and configured to receive the first fuse with the first fuse aligned with the first blade, the first fuse being removable from the first fuse clip through an opening in the outer housing.

9. A plug, comprising:

an outer housing having an interior cavity extending through the outer housing and an aperture;

an inner housing coupleable to the outer housing within at least a portion of the interior cavity of the outer housing, the inner housing having a first end and a second opposite end, the inner housing including:

a protrusion proximate the first end of the inner housing and structured to be received in the aperture of the outer housing to couple the inner housing to the outer housing in an operating configuration;

a plurality of corrugations extending from the inner housing proximate the second end of the inner housing and structured to engage a jacket of the electrical cable in the operating configuration;

a first fuse clip coupleable to the inner housing, the first fuse clip including a first blade coupled to a flange;

a second fuse clip coupleable to the inner housing, the second fuse clip including a first flange and a second flange structured to be crimped around wire insulation of a first electrical wire of an electrical cable in the operating configuration; and a first fuse coupleable to the inner housing in the operating configuration in contact with the flange of the first fuse clip and the first flange of the second fuse clip.

10. The plug of claim 9 wherein the first flange of the second fuse clip has a first height and a first width and the second flange of the second fuse clip has a second height and a second width, the first height being greater than the second height and the first width being greater than the second width.

11. The plug of claim 9 wherein the second fuse clip further includes a third flange between the first flange and the second flange of the second fuse clip, the third flange of the second fuse clip structured to be crimped around strands of wire of the first electrical wire of the electrical cable.

12. The plug of claim 9 wherein the inner housing includes a first cavity, a second cavity, a third cavity, and a fourth cavity, the flange of the first fuse clip and the first flange of the second fuse clip at least partially received in the first cavity in the operating position, the plug further comprising:

a second fuse coupleable to the inner housing within at least a portion of the second cavity of the inner housing in the operating configuration.

13. The plug of claim 12 further comprising:

a second blade coupleable to a second electrical wire of the electrical cable with the second electrical wire of the electrical cable extending through the fourth cavity and received at least partially within the third cavity of the inner housing in the operating configuration, the second blade including a protrusion extending perpendicularly to the second blade and structured to be received in an aperture in the inner housing to couple the second blade to the inner housing in the operating configuration, wherein the first electrical wire of the electrical cable is at least partially received within the fourth cavity in the operating configuration.

14. The plug of claim 12 wherein the first cavity, the second cavity, and the fourth cavity of the inner housing are in communication with each other and are separated from each other by walls of the inner housing.

15. The plug of claim 9 wherein the second end of the inner housing is planar with, or recessed with respect to, the outer housing, and wherein the plurality of corrugations extend from the inner housing from a first location where wires of the electrical cable are exposed from the jacket of the electrical cable to the second end of the inner housing.

16. A plug, comprising:

an outer housing having an interior cavity extending through the outer housing;

an inner housing coupleable to the outer housing within at least a portion of the interior cavity of the outer housing in an operating position;

a first fuse clip coupleable to the inner housing, the first fuse clip including a first blade coupled to a flange having a first wall and a second wall with at least one of the first wall and the second wall having a concave arc extending less than an entire height and less than an entire width of the at least one of the first wall and the second wall;

a second blade coupleable to the inner housing; and a first fuse coupleable to the inner housing in contact with the flange of the first fuse clip, the first fuse including a first end cap at least partially received in the concave arc of the flange of the first fuse clip.

17. The plug of claim 16 wherein the outer housing includes an aperture and the inner housing includes a protrusion structured to be received in the aperture of the outer housing in the operating position to couple the inner housing to the outer housing.

18. The plug of claim 16 further comprising:

a second fuse clip coupleable to the inner housing, the second fuse clip including a first flange structured to contact the first fuse in the operating position.

19. The plug of claim 18 wherein the second fuse clip includes a second flange structured to be crimped around at least one strand of wire of an electrical wire and a third flange structured to be crimped around wire insulation of the electrical wire.

20. The plug of claim 18 wherein the first flange of the second fuse clip includes a first wall and a second wall, at least one of the first wall and the second wall of the first flange having a concave arc structured to receive at least a portion of a second end cap of the first fuse in the operating position.

* * * * *